US010490320B2

(12) United States Patent
Tan

(10) Patent No.: US 10,490,320 B2
(45) Date of Patent: Nov. 26, 2019

(54) LONG STRAIGHT HIGH-FREQUENCY TRANSMISSION CABLE

(71) Applicant: Bellwether Electronic Corp, Taoyuan (TW)

(72) Inventor: Jie-Yau Tan, Kaohsiung (TW)

(73) Assignee: BELLWETHER ELECTRONIC CORP, Taoyuan (TW)

( * ) Notice: Subject to any disclaimer, the term of this patent is extended or adjusted under 35 U.S.C. 154(b) by 0 days.

(21) Appl. No.: 16/111,345

(22) Filed: Aug. 24, 2018

(65) Prior Publication Data

US 2019/0103203 A1 Apr. 4, 2019

(30) Foreign Application Priority Data

Sep. 29, 2017 (TW) ..... 106214518 U

(51) Int. Cl.
*H01B 7/08* (2006.01)
*H01B 7/04* (2006.01)

(52) U.S. Cl.
CPC ..... *H01B 7/0861* (2013.01); *H01B 7/04* (2013.01); *H01B 7/0823* (2013.01); *H01B 7/0838* (2013.01)

(58) Field of Classification Search
CPC ..... H01B 7/08
USPC ..... 174/117 F
See application file for complete search history.

(56) References Cited

U.S. PATENT DOCUMENTS 4,209,215 A * 6/1980 Verma ..... H01B 7/0838 439/497
4,513,170 A * 4/1985 Apodaca ..... H01B 7/38 174/115
5,250,127 A 10/1993 Hara
6,495,764 B1 * 12/2002 Hori ..... H01B 7/0861 174/117 F
8,669,483 B2 * 3/2014 Shimura ..... H01B 7/0838 174/110 R
2008/0230254 A1 * 9/2008 Kobayashi ..... H05K 1/0219 174/117 FF

* cited by examiner

*Primary Examiner* — Chau N Nguyen
(74) *Attorney, Agent, or Firm* — Li & Cai Intellectual Property (USA) Office

(57) ABSTRACT

A long straight high-frequency transmission cable includes a plurality of transmission wires, at least one ground wire, first and second insulating laminates, and first and second shielding layers. The transmission wires and the ground wire are parallel to each other. The first insulating laminate and the second insulating laminate are laminated with each other to cover the transmission wires and the ground wire. The first shielding layer and the second shielding layer are respectively laminated on the first insulating laminate and the second insulating laminate. The first insulating laminate has a plurality of first conductive plugs separately arranged along a length direction of the ground wire, and each two adjacent ones of the first conductive plugs have a spacing therebetween that is at least greater than 50 mm.

8 Claims, 9 Drawing Sheets

LONG STRAIGHT HIGH-FREQUENCY TRANSMISSION CABLE

CROSS-REFERENCE TO RELATED PATENT APPLICATION

This application claims the benefit of priority to Taiwan Patent Application No. 106214518, filed on Sep. 29, 2017. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a cable structure, and more particularly to a long straight high-frequency transmission cable which can serve as a flexible flat cable or any other data transmission cable.

BACKGROUND OF THE DISCLOSURE

The flexible flat cable (FFC) is a new type of data transmission cable and has the advantages of regular wire arrangement, high throughput, flat structure, small volume, easy detachment, and good flexibility, so that it can be easily and flexibly applied to various electronic devices. The FFC is particularly suitable for use under high-frequency and flexibility-demanding conditions, for example, as a connecting portion of a mobile element. The FFC can use a connector to perform an insert connection, or be directly soldered on a printed circuit board.

The FFC mainly includes a plurality of flat conductors that are arranged on a same plane and parallel to each other and an insulating layer laminated on the flat conductors. To avoid electromagnetic interference (EMI) and noise, a metal layer serving as a shielding layer is disposed on the periphery of the insulating layer and at least some of the flat conductors are electrically connected to the shielding layer to provide ground connections.

In the application of servers, with the diversification of server functions and the quickening of server computation abilities, there are higher requirements for internal jumpers, extension of signal transmission, and signal transmission between external machine groups. To increase the convenience of cable management, the FFC is often used for data transmission. However, the high-speed transmission characteristics of the conventional FFC are worse than that of the general high-speed transmission cable (e.g., a coaxial cable). In addition, when the conventional FFC extends beyond a certain length, crosstalk between transmission signals may be easily generated, and most solutions to such a problem cannot be adapted to automated mass production. For example, a large flat electrical cable disclosed in U.S. Pat. No. 5,250,127 requires that the line width and the line spacing of the transmission or ground wires cannot be too small, so that products cannot be effectively miniaturized.

SUMMARY OF THE DISCLOSURE

In response to the above-referenced technical inadequacies, the present disclosure provides a long straight high-frequency transmission cable for solving the crosstalk problem in the long cable and being reduced in size.

In one aspect, the present disclosure provides a long straight high-frequency transmission cable including a plurality of transmission wires, at least one ground wire, a first insulating laminate, a second insulating laminate, a first shielding layer, and a second shielding layer. The transmission wires and the at least one ground wire are parallel to each other. The first insulating laminate and the second insulating laminate are laminated with each other to cover the transmission wires and the at least one ground wire. The first insulating laminate has a plurality of first conductive plugs separately arranged along a length direction of the at least one ground wire, and each two adjacent ones of the first conductive plugs have a spacing therebetween that is at least greater than 50 mm. The first shielding layer and the second shielding layer are respectively laminated on the first insulating laminate and the second insulating laminate. The transmission wires each have a width greater than 0 and less than or equal to 0.8 mm, and the at least one ground wire has a width greater than 0 and less than or equal to 0.8 mm. The at least one ground wire is electrically connected to the first shielding layer by the first conductive plugs.

In certain embodiments, the second insulating laminate has a plurality of second conductive plugs separately arranged along the length direction of the at least one ground wire, and the at least one ground wire is electrically connected to the second shielding layer by the second conductive plugs. Each two adjacent ones of the second conductive plugs have a spacing therebetween that is at least greater than 50 mm.

In certain embodiments, the first conductive plugs are staggered with respect to the second conductive plugs.

In certain embodiments, a horizontal distance along the length direction of the at least one ground wire between any one of the first conductive plugs and a adjacent second conductive plug is at least greater than 25 mm.

In certain embodiments, the long straight high-frequency transmission cable has a length at least greater than 200 mm.

In certain embodiments, the first insulating laminate includes a first insulating adhesive layer and a first insulating cover layer formed on the first insulating adhesive layer, and is formed with a plurality of first laser processed through-holes to respectively accommodate the first conductive plugs. The second insulating laminate includes a second insulating adhesive layer and a second insulating cover layer formed on the second insulating adhesive layer, and is formed with a plurality of second laser processed through-holes to respectively accommodate the second conductive plugs.

In certain embodiments, the first shielding layer is laminated on the first insulating cover layer via a first conductive adhesive layer, and the second shielding layer is laminated on the second insulating cover layer via a second conductive adhesive layer.

In certain embodiments, one end of each the first conductive plug contacts the at least one ground wire and another end of each first conductive plug contacts the first conductive adhesive layer. One end of each second conductive plug contacts the at least one ground wire and another end of each second conductive plug contacts the second conductive adhesive layer.

In certain embodiments, the number of the ground wires is three, one of the ground wires is arranged between two pairs of the transmission wires, and another two of the ground wires are respectively arranged at two outer sides of two pairs of the transmission wires.

In certain embodiments, the first conductive plugs and the conductive plugs are made of a conductive silver paste.

One of the advantages of the instant disclosure is that the long straight high-frequency transmission cable in which "the first insulating laminate has a plurality of first conductive plugs separately arranged along a length direction of the at least one ground wire, and each two adjacent ones of the first conductive plugs have a spacing therebetween that is at least greater than 50 mm" and "the at least one ground wire is electrically connected to the first shielding layer by the first conductive plugs", can have a sufficient structural strength and flexibility when the cable length is increased, and suppress the crosstalk caused by the increase of the cable length.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
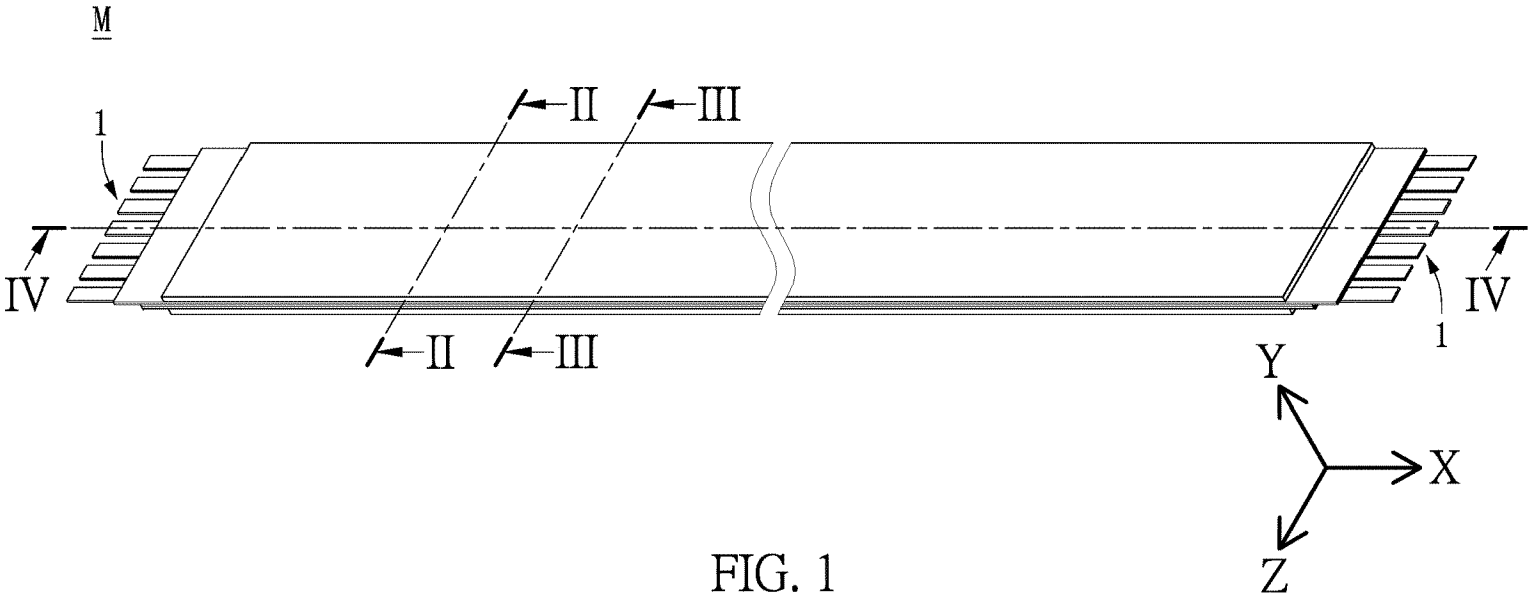
FIG. 1 is a perspective view of a long straight high-frequency transmission cable of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
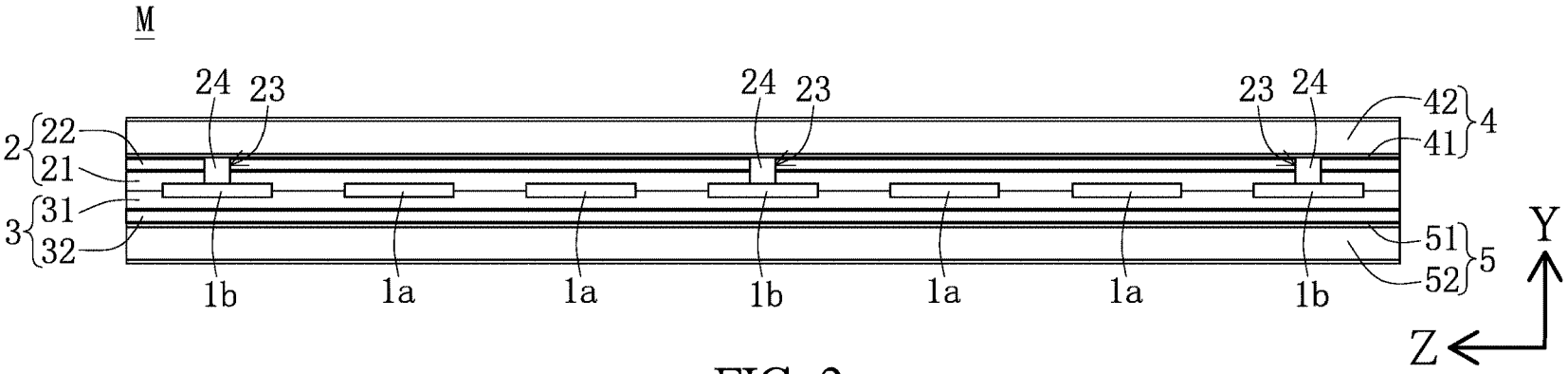
FIG. 2 is a cross-sectional schematic view along taken along a sectional line II-II of FIG. 1.
Figure 3:
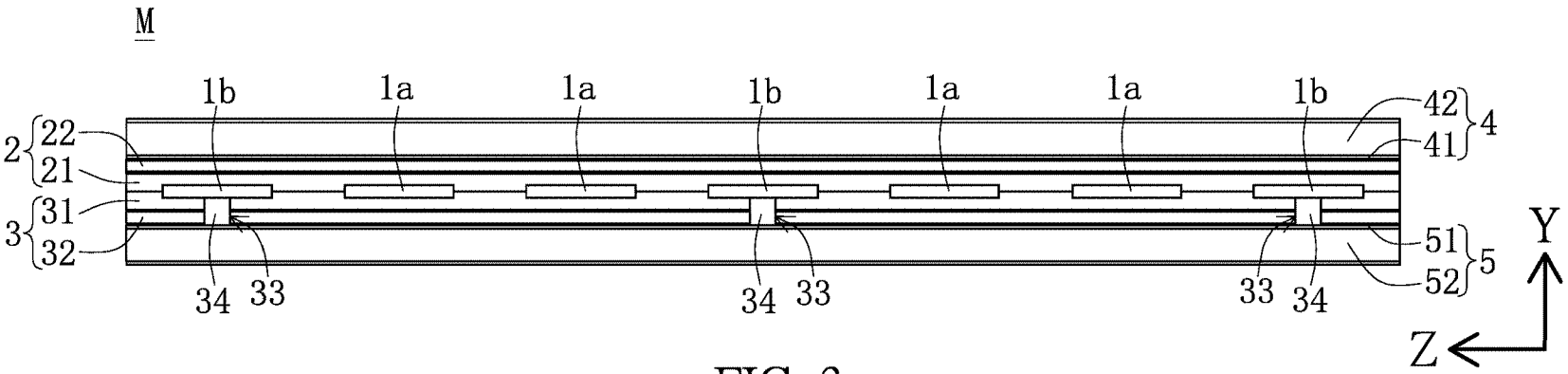
FIG. 3 is a cross-sectional schematic view along taken along a sectional line of FIG. 1.
Figure 4:
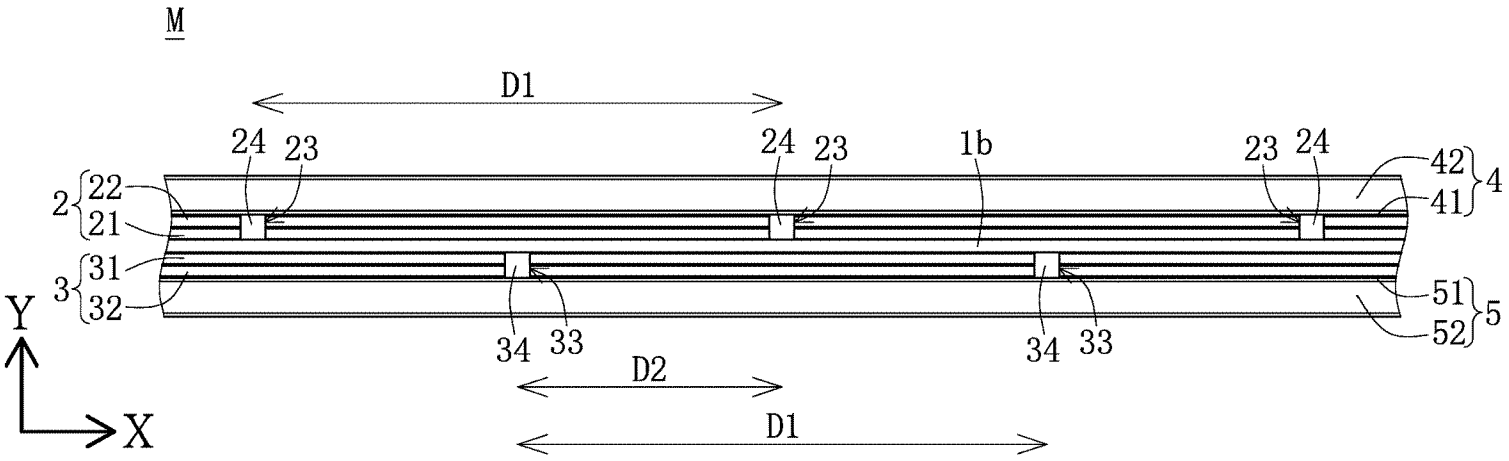
FIG. 4 is a cross-sectional schematic view along taken along a sectional line IV-IV of FIG. 1.

Referring to FIG. 1 to FIG. 4, FIG. 1 is a perspective view of a long straight high-frequency transmission cable of the present disclosure, and FIG. 2 to FIG. 4 are cross-sectional views respectively taken along a sectional line II-II, a sectional line and a sectional line IV-IV. The long straight high-frequency transmission cable M includes a plurality of transmission wires 1*a*, at least one ground wire 1*b*, first and second insulating laminates 2, 3, and first and second shielding layers 4, 5. The long straight high-frequency transmission cable M can serve as a flexible flat cable or any other data transmission cable, but the present disclosure is not limited thereto.

The transmission wires 1*a* and the ground wire 1*b* are parallelly arranged on a same plane at predetermined spacings, and each is a flat copper wire or a tin-plated copper wire. In the present disclosure, the number of the transmission wires 1*a* is four and the number of the ground wires 1*b* is three. Each transmission wire 1*a* and each ground wire 1*b* have a width greater than 0 and less than or equal to 0.8 mm. The spacing between each two adjacent ones of the transmission wires 1*a* and the spacing between any one of the transmission wires 1*a* and the adjacent ground wire 1*b* are greater than 0 and less than or equal to 1 mm, but are not limited thereto. In practice, the number, the line width and the line spacing of the wires can be adjusted depending on particular implementations. It should be noted that the long straight high-frequency transmission cable M, in which one of the ground wires 1*b* is arranged between two pairs of transmission wires 1*a*, and another two of the ground wires 1*b* are respectively arranged at two outer sides of the two pairs of transmission wires 1*a* (i.e., to be in a ground wire/transmission wire/transmission wire/ground wire/transmission wire/transmission wire/ground wire arrangement), can effectively reduce internal crosstalk.

The first insulating laminate 2 and the second insulating laminate 3 are laminated with each other to cover most of the transmission wires 1*a* and the ground wires 1*b* to only expose two ends of each of the wires for being connected to contact pins of the connector (not shown). The first shielding laminate 4 is formed on the first insulating laminate 2 and the second shielding laminate 5 is formed on the second insulating laminate 3. The first and second shielding laminates 4, 5 can provide shielding effects to protect the transmission wires 1*a* from the external electromagnetic interference.

More specifically, the first insulating laminate 2 includes a first insulating adhesive layer 21 and a first insulating cover layer 22. The second insulating laminate 3 includes a second insulating adhesive layer 31 and a second insulating cover layer 32. The first insulating cover layer 22 is laminated on the transmission wires 1*a* and the ground wires 1*b* (e.g., on one side of the wires) that are parallel to each other via the first insulating adhesive layer 21. The second insulating cover layer 32 is laminated on the transmission wires 1*a* and the ground wires 1*b* (e.g., on another side of the wires) that are parallel to each other via the second insulating adhesive layer 31, and is opposite to the first insulating cover layer 22. In the present embodiment, the first and second insulating adhesive layer 21, 31 can be formed by a suitable insulating adhesive and the first and second insulating cover layer 22, 32 can be formed by PET, PI or PPS, but are not limited thereto.

The first shielding laminate 4 includes a first conductive adhesive layer 41 and a first shielding layer 42. The second shielding laminate 5 includes a second conductive adhesive layer 51 and a second shielding layer 52. The first shielding layer 42 is laminated on the first insulating cover layer 22 via the first conductive adhesive layer 41. The second shielding layer 52 is laminated on the second insulating cover layer 32 via the second conductive adhesive layer 51 and is opposite to the first shielding layer 42. In the present embodiment, the first and second conductive adhesive layers 41, 51 can be formed by an electrically conductive material containing adhesive. The first and second shielding layers 42, 52 can be metal layers of aluminum, copper, or other suitable metal, but are not limited thereto.

In the ground connection design, the first insulating laminate 2 is formed with a plurality of first laser processed through-holes 23 that are arranged continuously along a length direction of the ground wires 1*b* (i.e., the X direction as shown in FIG. 4) and pass through the first insulating adhesive layer 21 and the first insulating cover layer 22 to accommodate a plurality of first conductive plugs 24. Accordingly, the first conductive plugs 24 are separately arranged along the length direction of the ground wires 1*b*, wherein one end of each of the first conductive plugs 24 contacts the corresponding ground wire 1*b* and another end of each of the first conductive plugs 24 contacts the first conductive adhesive layer 41. The second insulating laminate 3 is formed with a plurality of second laser processed through-holes 33 that are arranged continuously along the length direction of the ground wires 1*b* and pass through the second insulating adhesive layer 31 and the second insulating cover layer 32 to accommodate a plurality of second conductive plugs 34. Accordingly, the second conductive plugs 34 are separately arranged along the length direction of the ground wires 1*b*, wherein one end of each second conductive plug 34 contacts the corresponding ground wire 1*b* and another end of each second conductive plug 34 contacts the second conductive adhesive layer 51. In the present embodiment, the first and second conductive plugs can be formed by a metal, alloy, or non-metal material (e.g., conductive carbon material) or a mixture, but are not limited thereto.

Figure 5:
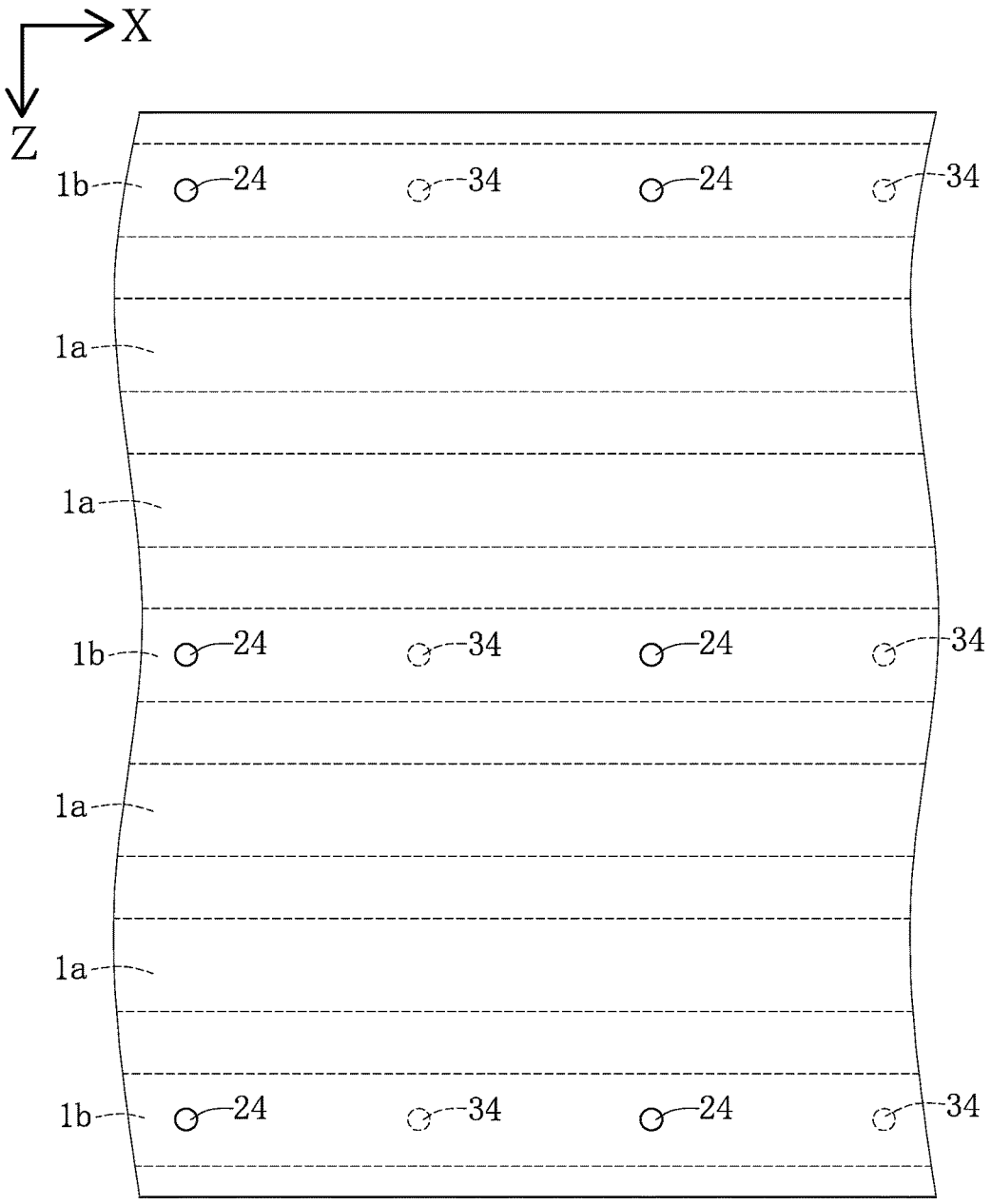
FIG. 5 is a top schematic view of the long straight high-frequency transmission cable of the present disclosure without a shielding layer.

Each ground wire 1*b* is not only electrically connected to the first shielding layer 42 via the first conductive plugs 24, but also electrically connected to the second shielding layer 52 via the second conductive plugs 34, so that the crosstalks between the transmission wires 1*a* (i.e., the internal crosstalks) can be effectively reduced. It should be noted that, as shown in FIGS. 4 and 5, the design of "the plurality of first conductive plugs 24 are staggered with respect to the plurality of second conductive plugs 34" is beneficial to an increase in the cable length. Accordingly, the long straight high-frequency transmission cable M can have a length of 200 mm or greater and a sufficient structural strength and flexibility while increasing the length. Preferably, a predetermined horizontal distance D1 between two adjacent ones of the first conductive plugs 24 or two adjacent ones of the two second conductive plugs 34 is at least 50 mm. A horizontal distance D2 between any one of the first conductive plugs 24 and a adjacent second conductive plug 34 is at least 25 mm. Without negatively affecting the expected effect of the present disclosure, as shown in FIG. 6, the plurality of first conductive plugs 24 can also correspond in position to the plurality of second conductive plugs 34.

Figure 6:
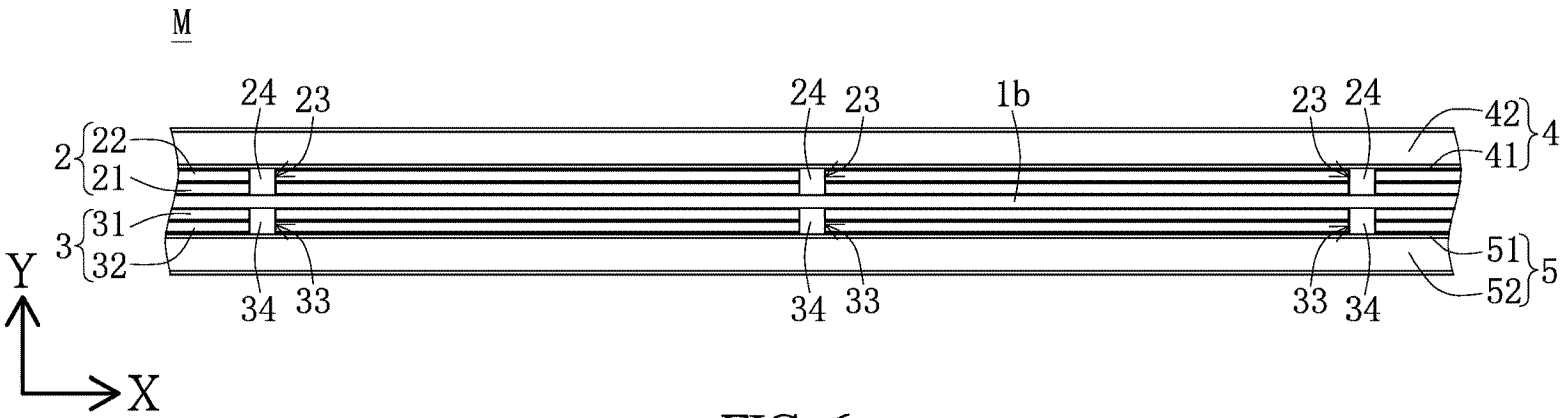
FIG. 6, which is similar to FIGS. 2 and 3, is a cross-sectional schematic view according to one embodiment of the present disclosure.

Although each ground wire 1*b* of the long straight high-frequency transmission cable M as shown in FIGS. 4 to 6 is electrically connected to the first and second shielding layers 42, 52 by the first and second conductive plugs 24, 34 respectively, in practice, each ground wire 1*b* can only be electrically connected to the first shielding layer 42 by the first conductive plugs 24 that are spaced at predetermined distances of at least 50 mm, or electrically connected to the second shielding layer 52 by the second conductive plugs 34 that are spaced at predetermined distances of at least 50 mm, so as to significantly reduce the crosstalk. That is to say, FIGS. 4 to 6 show only exemplary embodiments of the present disclosure, and should not be construed as limiting the present disclosure. The long straight high-frequency transmission cable M can be manufactured by a roll-to-roll technique, so as to have the advantages of high production efficiency, low cost, high process stability, and stable product quality, and is suitable for large scale production. The specific steps of the process are described below.

Firstly, a plurality of flat conductors (i.e., transmission wires 1*a* and ground wires 1*b*) are pulled out a predetermined length from a coiled state and parallelly arranged on a same plane. Next, the first and second insulating laminates 2, 3 are pulled out a predetermined length from a coiled state to cover the flat conductors from upper and lower sides. Next, a plurality of first laser processed through-holes 23 are formed on the first insulating laminate 2 by a laser process, and if needed, a plurality of second laser processed through-holes 33 are formed on the second insulating laminate 3 by a laser process. Accordingly, the first and second laser processed through-holes 23, 33 can each have a highly accurate shape and position. Next, conductive pastes (e.g., conductive silver pastes) are filled in the first laser processed through-holes 23, and if needed, the second laser processed through-holes 33, and subsequently, the conductive pastes are cured to form the first and second conductive plugs 24, 34. In other embodiments, conductors can be directly inserted into the first laser processed through-holes 23, and if needed, the second laser processed through-holes 33, thereby omitting a curing process. Lastly, a first shielding layer 42 is laminated on the first insulating laminate 2 via a first conductive adhesive layer 41, and a second shielding layer 52 is laminated on the second insulating laminate 3 via a second conductive adhesive layer 51.

In the present embodiment, the step of adhering the first shielding layer 42 can be executed after the formation of the first conductive plugs 24. Subsequently, the step of adhering the second shielding layer 52 can be executed after the formation of the second conductive plugs 34. Reference is made to FIGS. 7 to 10, which show the comparison of transmission performances between the long straight high-frequency transmission cable M of the present disclosure (hereinafter "the present transmission cable") and the conventional transmission cable. It should be noted that in the present transmission cable, three ground wires 1*b* are used to separate two pairs of the transmission wires 1*a*. That is to say, one of the ground wires 1*b* is arranged between two pairs of the transmission wires 1*a*, and another two of the ground wires 1*b* are respectively arranged at two outer sides of the two pairs of transmission wires 1*a*. In addition, the three ground wires 1*b* are electrically connected to the first and second shielding layers 42, 52 by the first and second conductive plugs 24, 34, respectively. In the conventional transmission cable, only some ground wires are directly in contact with the shielding layer.

Figure 7:
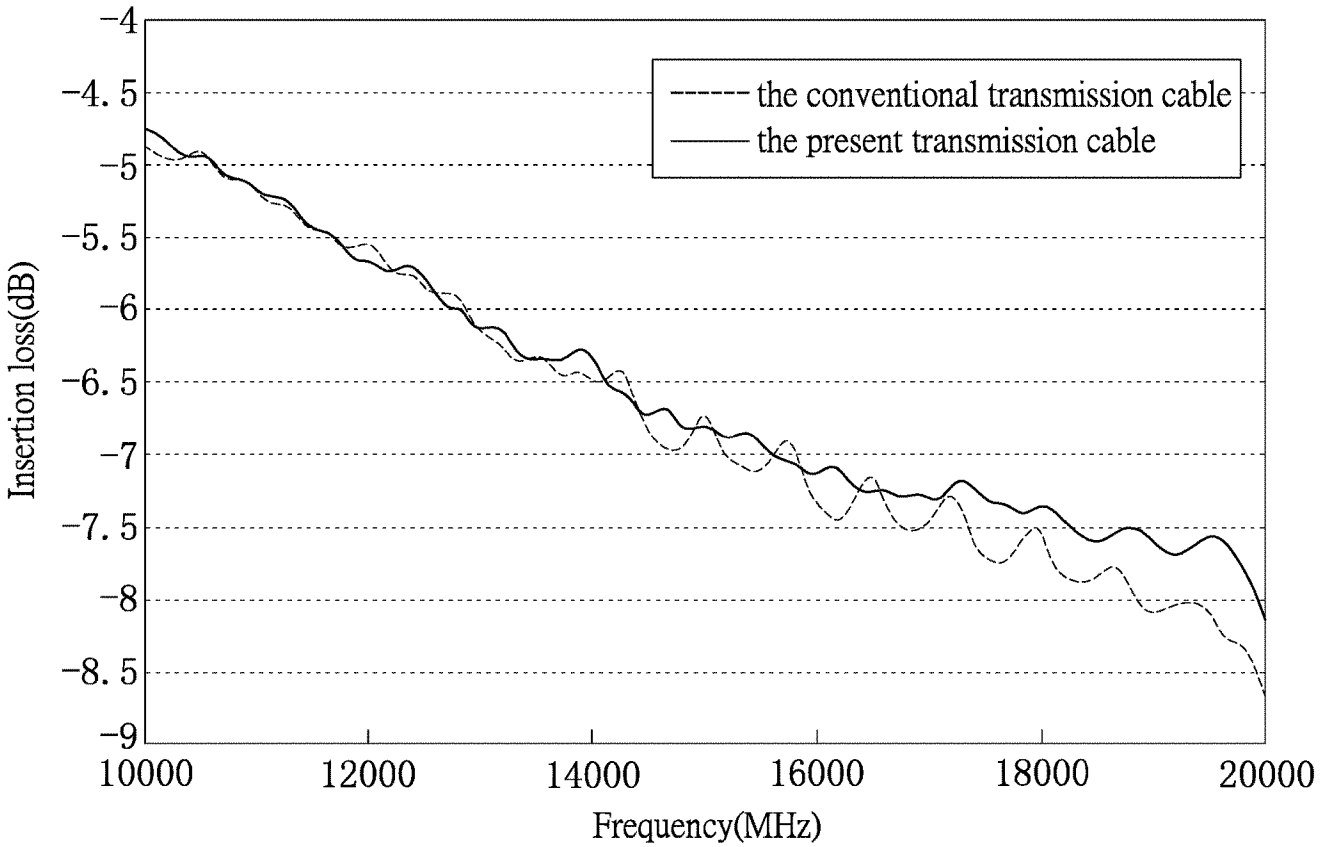
FIG. 7 shows a comparison of insertion losses at different frequencies between the present disclosure and the related art.
Figure 8:
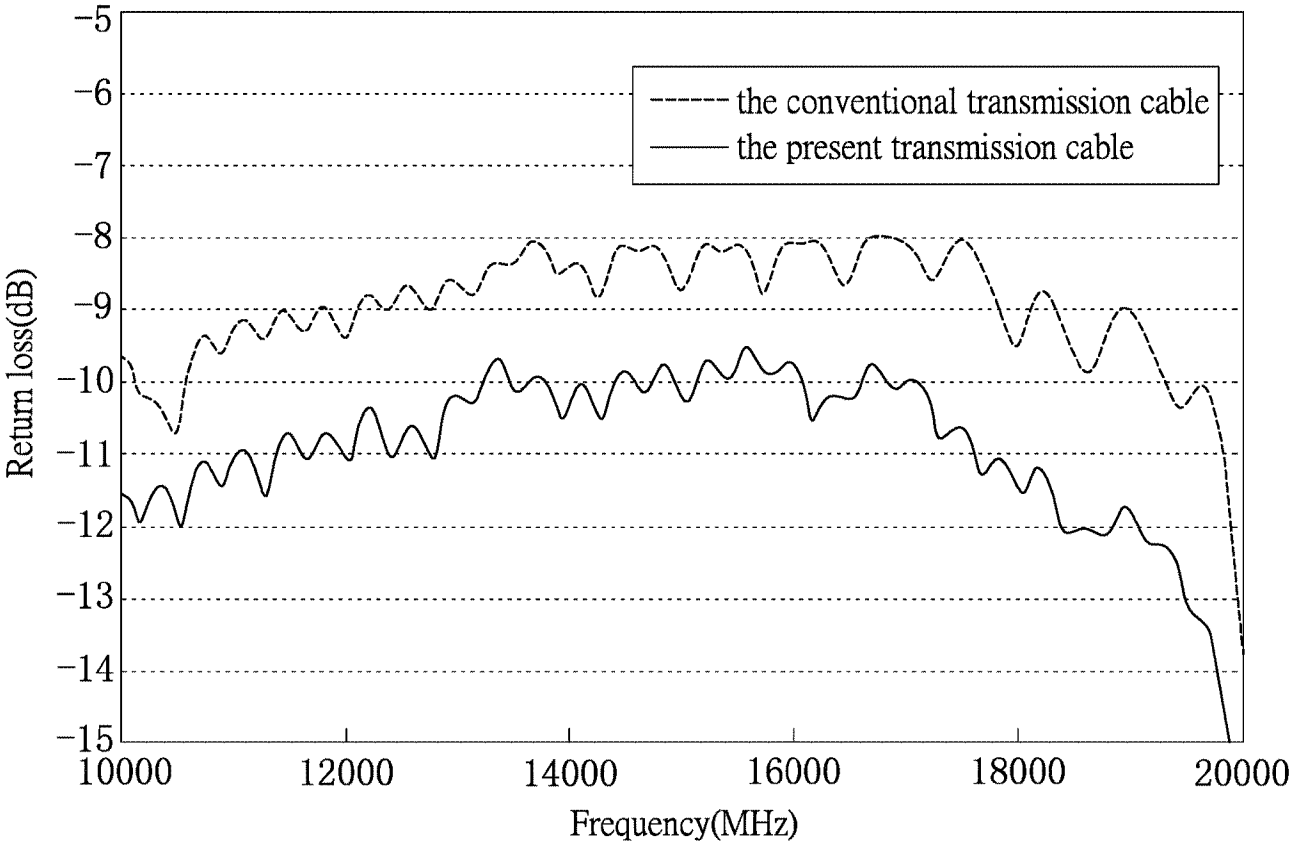
FIG. 8 shows a comparison of return losses at different frequencies between the present disclosure and the related art.
Figure 9:
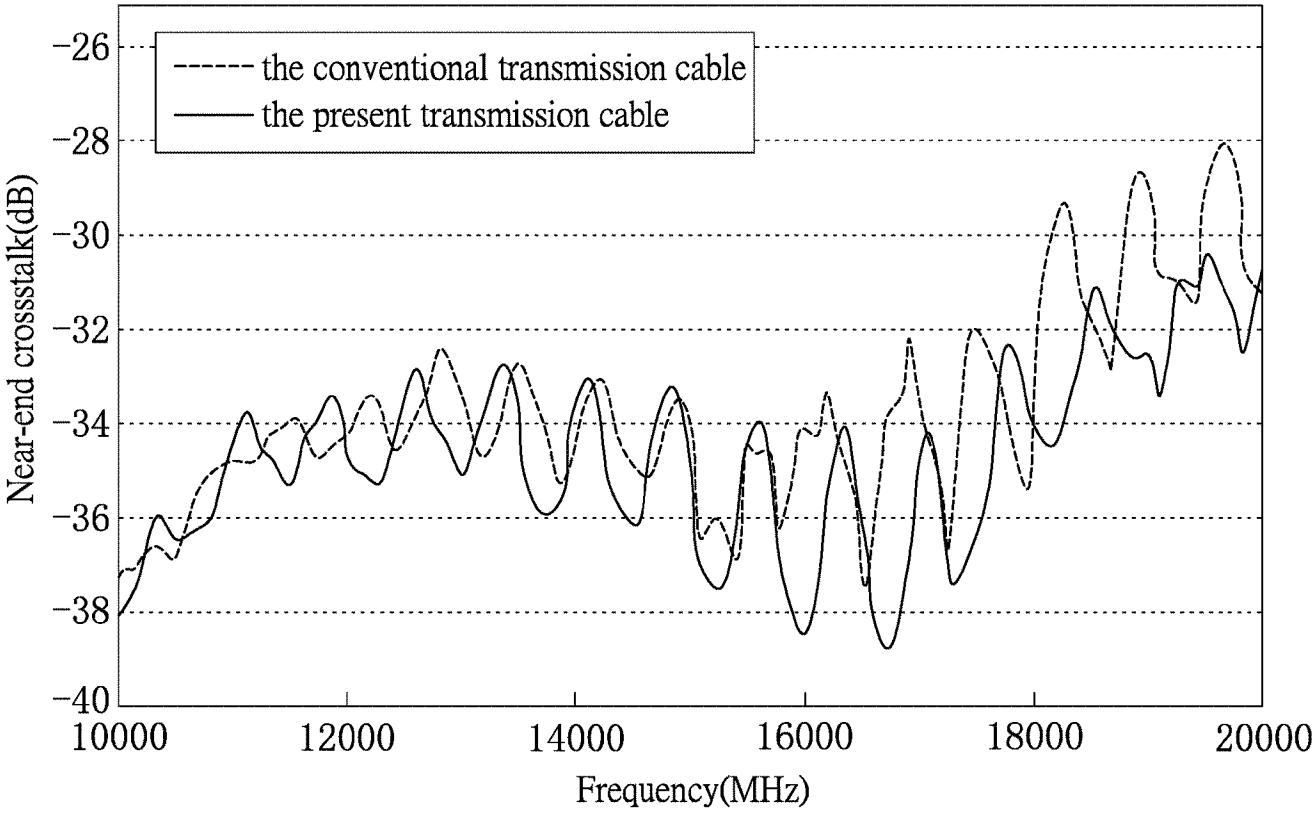
FIGS. 9 and 10 respectively show comparisons of far-end and near-end crosstalks at different frequencies between the present disclosure and the related art.
Figure 10:
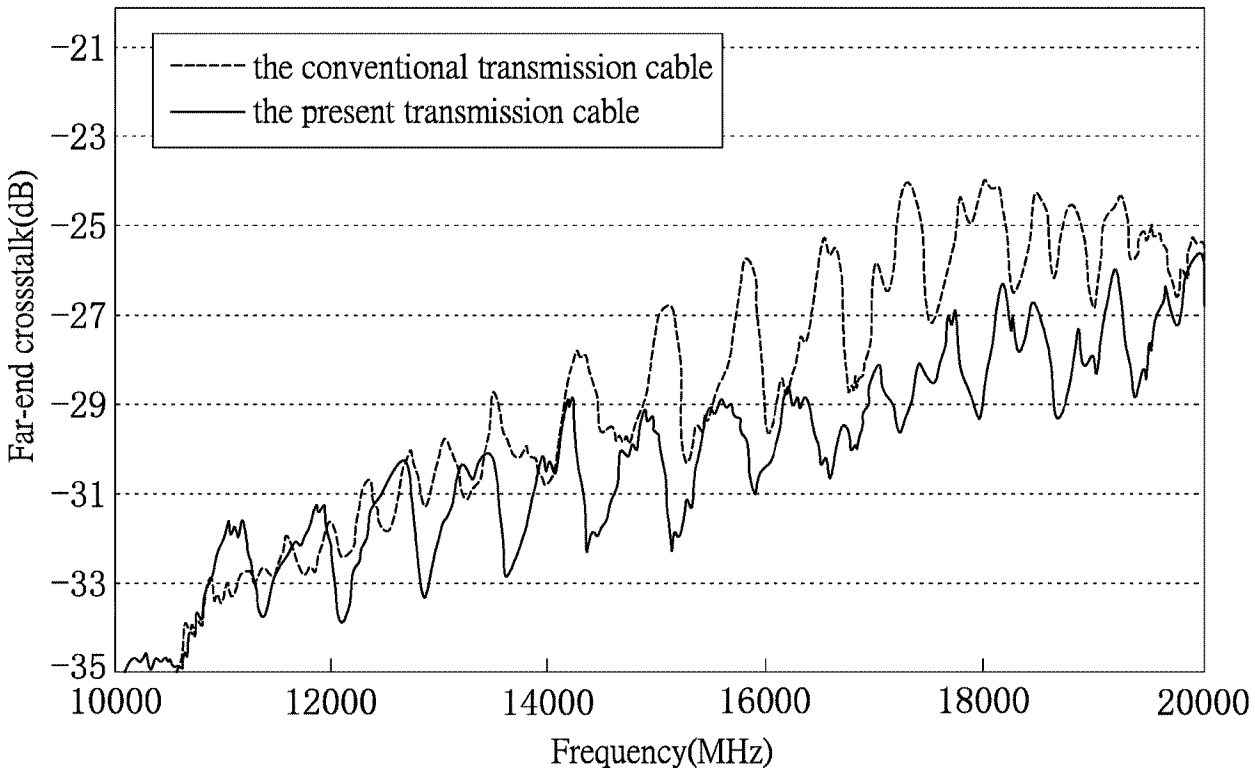

As shown in FIG. 7, the present transmission cable can have a significantly reduced signal attenuation, especially in the high frequency region. As shown in FIG. 8, the difference in impedance matching characteristics between the cable and the system would cause return losses. The present transmission cable, compared with the conventional transmission cable, provides an increased flexibility in impedance matching. As shown in FIGS. 9 and 10, the crosstalk caused by adjacent signals in a high-frequency transmission system would negatively affect the signal integrity of transmitted signals. The present transmission cable, compared with the conventional transmission cable, has a stable trend in the high frequency region.

One of the advantages of the instant disclosure is that the long straight high-frequency transmission cable in which "the first insulating laminate has a plurality of first conductive plugs separately arranged along a length direction of the at least one ground wire, and the two adjacent first conductive plugs have a spacing therebetween that is at least greater than 50 mm" and "the at least one ground wire is electrically connected to the first shielding layer by the first conductive plugs", can have a sufficient structural strength and flexibility when the cable length is increased, and suppress the crosstalks caused by the increase of the cable length.

Based on the above, the expected effect of the present disclosure can be achieved when the second insulating laminate has a plurality of second conductive plugs separately arranged along a length direction of the at least one ground wire, and the at least one ground wire is electrically connected to the second shielding layer by the second conductive plugs, and the two adjacent second conductive plugs have a spacing therebetween that is at least greater than 50 mm. In addition, the at least one ground wire can be reliably electrically connected to the shielding layers when the first and second conductive plugs are in a specific arrangement.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A long straight high-frequency transmission cable, comprising:

a plurality of transmission wires and at least one ground wire parallel to each other;

a first insulating laminate and a second insulating laminate laminated with each other to cover the transmission wires and the at least one ground wire, wherein the first insulating laminate has a plurality of first conductive plugs separately arranged along a length direction of the at least one ground wire, and each two adjacent ones of the first conductive plugs have a spacing therebetween that is at least greater than 50 mm, and wherein the second insulating laminate has a plurality of second conductive plugs separately arranged along the length direction of the at least one ground wire, each two adjacent ones of the second conductive plugs have a spacing therebetween that is at least greater than 50 mm, and the first conductive plugs are staggered with respect to the second conductive plugs; and a first shielding layer and a second shielding layer respectively laminated on the first insulating laminate and the second insulating laminate;

wherein the transmission wires each have a width greater than 0 and less than or equal to 0.8 mm, and the at least one ground wire has a width greater than 0 and less than or equal to 0.8 mm;

wherein the at least one ground wire is electrically connected to the first shielding layer by the first conductive plugs and is electrically connected to the second shielding layer by the second conductive plugs.

2. The long straight high-frequency transmission cable according to claim 1, a horizontal distance along the length direction of the at least one ground wire between any one of the first conductive plugs and a adjacent second conductive plug is at least greater than 25 mm.

3. The long straight high-frequency transmission cable according to claim 1, having a length at least greater than 200 mm.

4. The long straight high-frequency transmission cable according to claim 1, wherein the first insulating laminate includes a first insulating adhesive layer and a first insulating cover layer formed on the first insulating adhesive layer, and is formed with a plurality of first laser processed through-holes to respectively accommodate the first conductive plugs, and wherein the second insulating laminate includes a second insulating adhesive layer and a second insulating cover layer formed on the second insulating adhesive layer, and is formed with a plurality of second laser processed through-holes to respectively accommodate the second conductive plugs.

5. The long straight high-frequency transmission cable according to claim 4, wherein the first shielding layer is laminated on the first insulating cover layer via a first conductive adhesive layer, and the second shielding layer is laminated on the second insulating cover layer via a second conductive adhesive layer.

6. The long straight high-frequency transmission cable according to claim 5, wherein one end of each of the first conductive plugs contacts the at least one ground wire and another end of each of the first conductive plugs contacts the first conductive adhesive layer, and wherein one end of each of the second conductive plugs contacts the at least one ground wire and another end of each of the second conductive plugs contacts the second conductive adhesive layer.

7. The long straight high-frequency transmission cable according to claim 1, wherein the at least one ground wire includes three ground wires, one of the ground wires is arranged between two pairs of the transmission wires, and another two of the ground wires are respectively arranged at two outer sides of the two pairs of the transmission wires.

8. The long straight high-frequency transmission cable according to claim 1, wherein the first conductive plugs and the second conductive plugs are made of a conductive silver paste.

* * * * *